US011781539B2

(12) United States Patent
Takakura

(10) Patent No.: US 11,781,539 B2
(45) Date of Patent: Oct. 10, 2023

(54) HAND GRIP MECHANISM, DRIVE MECHANISM, AND AIR PUMP

(71) Applicants: YOKOGAWA ELECTRIC CORPORATION, Tokyo (JP); Yokogawa Test & Measurement Corporation, Tokyo (JP)

(72) Inventor: Masato Takakura, Hachioji (JP)

(73) Assignees: YOKOGAWA ELECTRIC CORPORATION, Tokyo (JP); Yokogawa Test & Measurement Corporation, Tokyo (JP)

( * ) Notice: Subject to any disclaimer, the term of this patent is extended or adjusted under 35 U.S.C. 154(b) by 0 days.

(21) Appl. No.: 17/508,429

(22) Filed: Oct. 22, 2021

(65) Prior Publication Data

US 2022/0145870 A1 May 12, 2022

(30) Foreign Application Priority Data

Nov. 6, 2020 (JP) ..... 2020-186154

(51) Int. Cl.
*F04B 33/00* (2006.01)

(52) U.S. Cl.
CPC ..... *F04B 33/00* (2013.01)

(58) Field of Classification Search
CPC ..... F04B 33/00; B25B 7/10; B25B 7/12
See application file for complete search history.

(56) References Cited

U.S. PATENT DOCUMENTS

2009/0025797 A1* 1/2009 Ratner ..... F16K 24/04 137/228
2012/0144963 A1* 6/2012 He ..... B25B 7/12 81/381
2016/0281699 A1* 9/2016 Gnessin ..... F16K 11/0704

OTHER PUBLICATIONS

Tritan Enigneering, Druck PV211 Pneumatic Hand pump Tutorial, Apr. 26, 2021.-.-.https://www.youtube.com/watch?v=BgQIixXmTSo (Year: 2021).*
Sara Kinsey, Using the Pneumatic test pump it, Jan. 31, 2012,-.-. https://www.youtube.com/watch?v=bpsGMmyYFFw&t=1s (Year: 2012).*
"Druck PV211—Pneumatic pressure and vacuum pump", GE Industrial Sensing, 2007, K408 Issue 1, total 2 pages; Cited in Specification.

* cited by examiner

*Primary Examiner* — Connor J Tremarche
(74) *Attorney, Agent, or Firm* — Rankin, Hill & Clark LLP

(57) ABSTRACT

A hand grip mechanism includes a first member, a second member connected to the first member in a vertically moveable manner, a spring providing a biasing force to lower the second member with respect to the first member, and a hand grip configured by two grip links, each including a grip rotatably connected to the first member, a link rotatably connected to the second member below a connecting portion between the first member and the grip, and first and second connecting shafts each connecting the grip and the link below a connecting portion between the second member and the link. By a pressing operation to squeeze the hand grip against the biasing force of the spring, the grip and link in each grip link rotate relative to each other about the first connecting shaft during initial movement and about the second connecting shaft during final movement.

6 Claims, 14 Drawing Sheets

HAND GRIP MECHANISM, DRIVE MECHANISM, AND AIR PUMP

CROSS-REFERENCE TO RELATED APPLICATION

The present application claims priority to Japanese Patent Application No. 2020-186154 filed on Nov. 6, 2020, the entire contents of which are incorporated herein by reference.

TECHNICAL FIELD

The present disclosure relates to a hand grip mechanism, a drive mechanism, and an air pump.

BACKGROUND

A hand grip mechanism that constitutes a drive mechanism for an air pump used for calibration of pressure equipment and the like is known. For example, see Non-patent Literature (NPL) 1. The hand grip mechanism includes a first member, a second member connected to the first member in a vertically moveable manner, a spring that provides a biasing force to lower the second member with respect to the first member, and a hand grip configured by two grip links. Each of the grip links includes a grip rotatably connected to the first member, a link rotatably connected to the second member below a connecting portion between the first member and the grip, and a connecting shaft rotatably connecting the grip and the link below a connecting portion between the second member and the link. The drive mechanism is configured by the hand grip mechanism, and a pressure chamber is formed by the first member and the second member. The pressure chamber is driven to increase or decrease in volume by manual performance of a driving operation that includes a pressing operation, to squeeze the hand grip against the biasing force of the spring, and release of the pressing operation.

CITATION LIST

Non-patent Literature

NPL 1: Druck PV211—Pneumatic pressure and vacuum pump, GE Industrial Sensing

SUMMARY

A hand grip mechanism according to an embodiment includes:

a first member;

a second member connected to the first member in a vertically moveable manner;

a spring configured to provide a biasing force to lower the second member with respect to the first member; and a hand grip configured by two grip links, each grip link including a grip rotatably connected to the first member, a link rotatably connected to the second member below a connecting portion between the first member and the grip, and a first connecting shaft and a second connecting shaft each connecting the grip and the link below a connecting portion between the second member and the link, wherein by a pressing operation to squeeze the hand grip against the biasing force, the grip and the link in each grip link rotate relative to each other about the first connecting shaft during initial movement and rotate relative to each other about the second connecting shaft during final movement.

DETAILED DESCRIPTION

Figure 1:
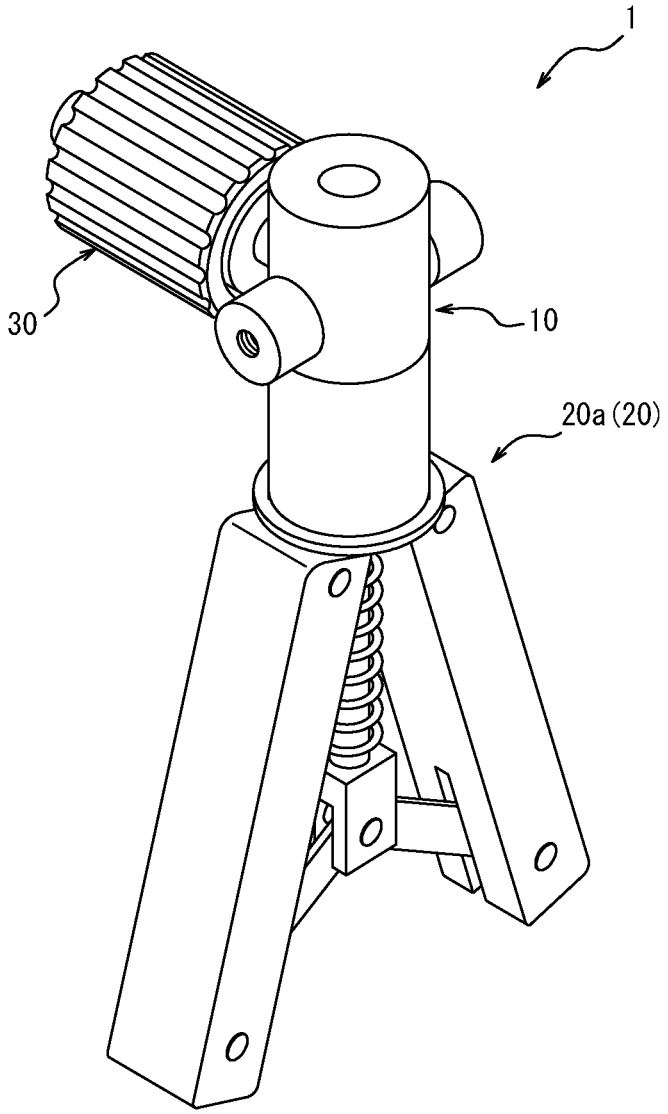
FIG. 1 is an external view of an air pump that has a drive mechanism configured by a hand grip mechanism according to a first comparative example.
Figure 2:
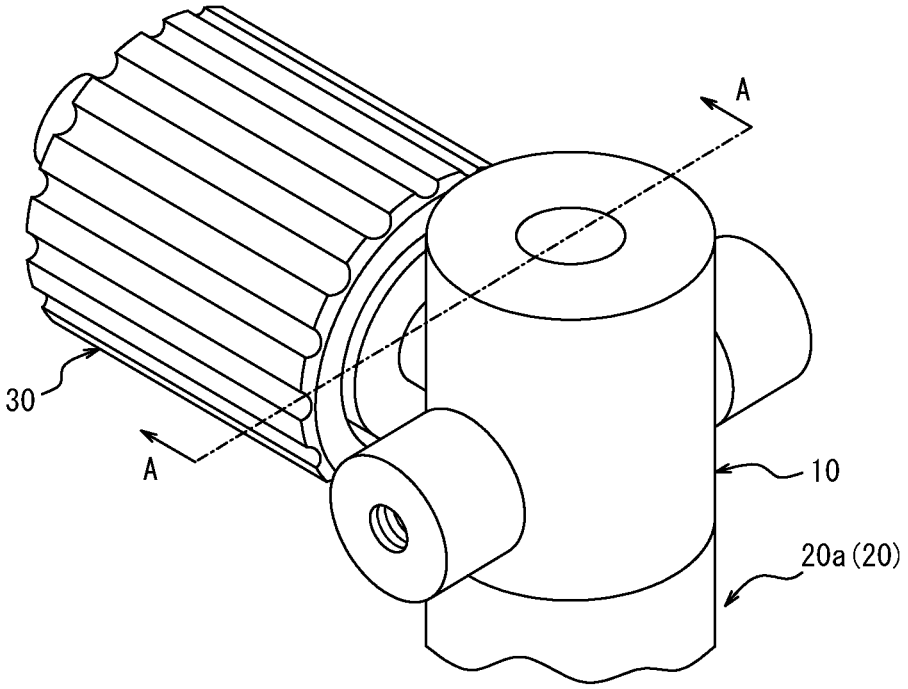
FIG. 2 is a partially enlarged view of FIG. 1.
Figure 3:
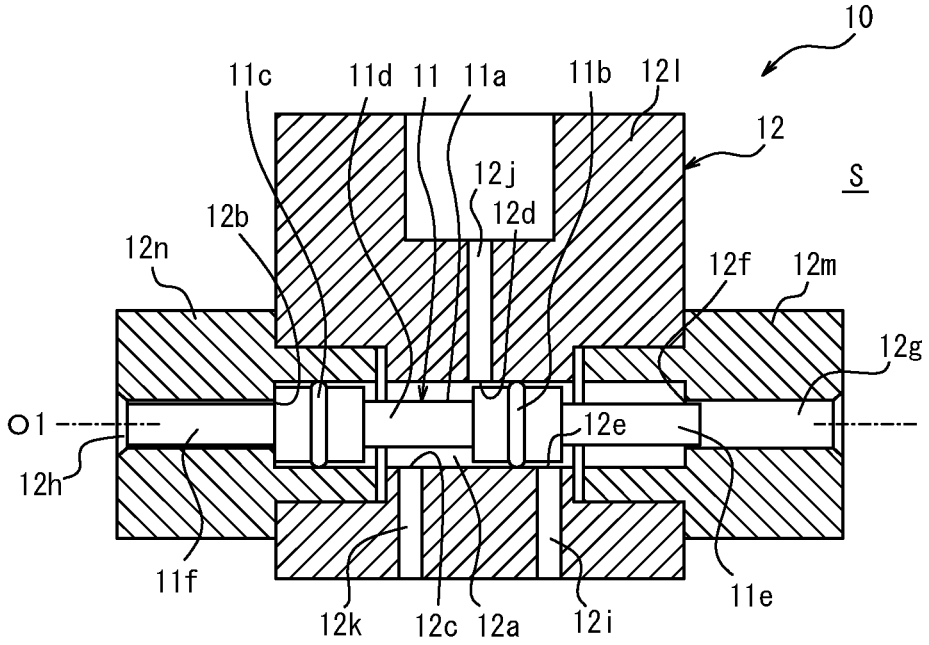
FIG. 3 is a cross-section along the A-A line in FIG. 2, illustrating the state when an actuating member is in a pressurized position.

There is demand for improved operability of a hand grip mechanism by a reduction in the operating force required for pressing operations.

A hand grip mechanism according to several embodiments includes a first member; a second member connected to the first member in a vertically moveable manner; a spring configured to provide a biasing force to lower the second member with respect to the first member; and a hand grip configured by two grip links, each grip link including a grip rotatably connected to the first member, a link rotatably connected to the second member below a connecting portion between the first member and the grip, and a first connecting shaft and a second connecting shaft each connecting the grip and the link below a connecting portion between the second member and the link, wherein by a pressing operation to squeeze the hand grip against the biasing force, the grip and the link in each grip link rotate relative to each other about the first connecting shaft during initial movement and rotate relative to each other about the second connecting shaft during final movement. According to such a configuration, the positions of the first connecting shaft and second connecting shaft are set appropriately, thereby reducing the operating force required for the pressing operation and improving operability.

In an embodiment, a downward angle formed by a straight line passing through one second connecting shaft and the connecting portion between the link, connected to the one second connecting shaft, and the second member, and a straight line passing through the other second connecting shaft and the connecting portion between the link, connected to the other second connecting shaft, and the second member is larger than a downward angle formed by a straight line passing through one first connecting shaft and the connecting portion between the link, connected to the one first connecting shaft, and the second member, and a straight line passing through the other first connecting shaft and the connecting portion between the link, connected to the other first connecting shaft, and the second member. According to such a configuration, the operating force required for the pressing operation can more reliably be reduced to improve operability.

In an embodiment, in each grip link, the connecting portion between the second member and the link is provided farther inward than the central axis of the hand grip when viewed from the grip link. According to such a configuration, the operating force required for the pressing operation can more reliably be reduced to improve operability.

A drive mechanism according to several embodiments is configured by the hand grip mechanism, and a pressure chamber is formed by the first member and the second member. According to such a configuration, the operability of the hand grip mechanism can be improved.

In an embodiment, the first member includes a cylinder, and the second member includes a piston. According to such a configuration, a drive mechanism can be formed with a simple structure.

An air pump according to several embodiments includes the drive mechanism. According to such a configuration, the operability of the hand grip mechanism can be improved.

In an embodiment, the air pump includes a flow path switching mechanism including an actuating member provided with a valve body, and a housing provided with a valve chamber configured to house the valve body in an advanceable and retractable manner between a pressurized position and a depressurized position, the valve body being configured to enable an intake port to communicate with an inlet and enable an outlet to communicate with a connecting port in the pressurized position, and to enable the connecting port to communicate with the inlet and enable the outlet to communicate with the exhaust port in the depressurized position, and the pressure chamber is configured to communicate with the inlet and the outlet. According to such a configuration, the flow path switching mechanism enables the operating specification of the air pump to be switched between a pressurizing specification and a depressurizing specification.

In an embodiment, the air pump includes a vent opening configured to communicate with the connecting port of the flow path switching mechanism both when the actuating member is in the pressurized position and in the depressurized position, and an opening and closing member configured to open and close the vent opening. According to such a configuration, the positive or negative pressure imparted to the internal space of the object by the air pump can be weakened and eliminated by opening the vent opening with the opening and closing member.

According to the present disclosure, a hand grip mechanism, a drive mechanism, and an air pump with improved operability can be provided.

Embodiments of the present disclosure are described below with reference to the drawings. The same reference sign is appended to corresponding elements across drawings.

First, a comparative example will be described. A drive mechanism 20 configured by a hand grip mechanism 20*a* according to a first comparative example illustrated in FIG. 1 is a mechanism for driving a manually operated air pump 1. The air pump 1 includes a flow path switching mechanism 10, a drive mechanism 20, and a vent mechanism 30.

Figure 4:
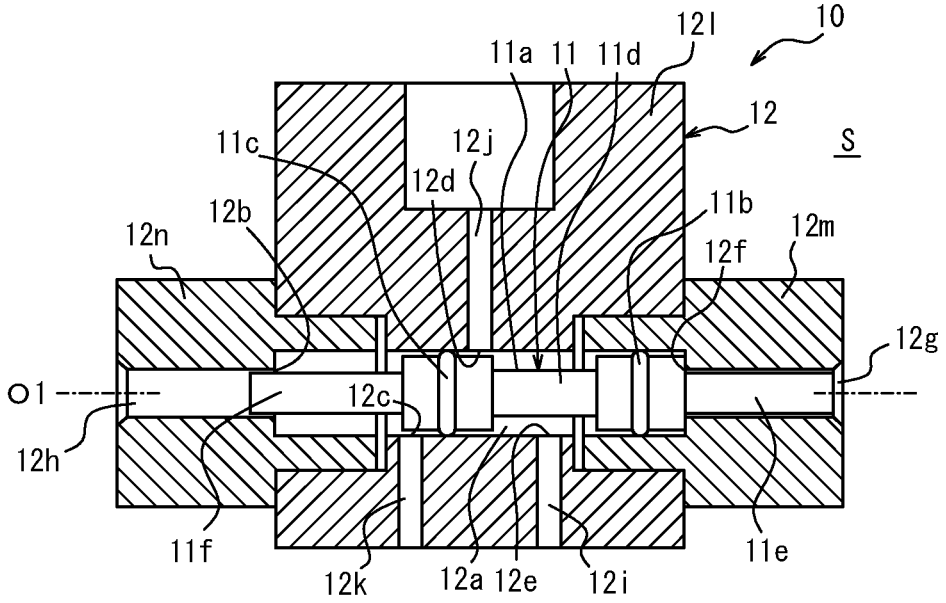
FIG. 4 is a cross-sectional view illustrating the state when the actuating member has moved to a depressurized position from the state illustrated in FIG. 3.

As illustrated in FIGS. 1 to 4, the flow path switching mechanism includes an actuating member 11 provided with a valve body 11*a*, and a housing 12 provided with a valve chamber 12*a* configured to house the valve body 11*a* in an advanceable and retractable manner between a pressurized position (see FIG. 3) and a depressurized position (see FIG. 4). The valve chamber 12*a* includes an exhaust port 12*b*; an outlet 12*c* disposed in front of the exhaust port 12*b*, in the direction from the pressurized position towards the depressurized position (for the sake of explanation, the direction from the pressurized position towards the depressurized position is defined as "in front" or "forward" in the flow path switching mechanism 10); a connecting port 12*d* disposed in front of the outlet 12*c*; an inlet 12*e* disposed in front of the connecting port 12*d*; and an air intake 12*f* disposed in front of the inlet 12*e*. The valve body 11*a* is configured to enable the intake port 12*f* to communicate with the inlet 12*e* and enable the outlet 12*c* to communicate with the connecting port 12*d* in the pressurized position, and to enable the connecting port 12*d* to communicate with the inlet 12*e* and enable the outlet 12*c* to communicate with the exhaust port 12*b* in the depressurized position.

The housing 12 includes the valve chamber 12*a* that is provided with a cylindrical inner peripheral surface centered on a first central axis O1 extending along the front-back direction. The air intake 12*f* is provided at the front end of the valve chamber 12*a*. The air intake 12*f* is the back end (downstream end) of an air intake passage 12*g* extending in the front-back direction. The front end (upstream end) of the air intake passage 12*g* opens to an external space S. The exhaust port 12*b* is provided at the back end of the valve chamber 12*a*. The exhaust port 12*b* is the front end (upstream end) of an exhaust passage 12*h* extending in the front-back direction. The back end (downstream end) of the exhaust passage 12*h* opens to the external space S. The inlet 12*e*, the connecting port 12*d*, and the outlet 12*c* are provided on the inner peripheral surface of the valve chamber 12*a*. The inlet 12*e* is the radially inner end of an inflow passage 12*i* extending in the radial direction. The connecting port 12*d* is the radially inner end of a connecting channel 12*j* extending in the radial direction. The outlet 12*c* is the radially inner end of an outflow passage 12*k* extending in the radial direction.

The housing 12 includes a housing body 121, a first end member 12*m*, and a second end member 12*n*. The housing body 121 includes a front-back middle portion of the valve chamber 12*a*, the inflow passage 12*i*, the connecting channel 12*j*, and the outflow passage 12*k*. The first end member 12*m* includes the air intake passage 12*g* and the front end of the valve chamber 12*a*. The second end member 12*n* includes the exhaust passage 12*h* and the back end of the valve chamber 12*a*. The first end member 12*m* and the second end member 12*n* are each integrally connected to the housing body 121 by means such as fitting, mating, screw coupling, or welding.

The valve body 11*a* includes an annular first sealing portion 11*b* in close contact with the inner peripheral surface of the valve chamber 12*a* and a second sealing portion 11*c* provided behind the first sealing portion 11*b* in close contact with the inner peripheral surface of the valve chamber 12*a*. The first sealing portion 11*b* and the second sealing portion 11*c* are each formed by an annular elastic member that is integrally connected to the valve body 11*d*.

The actuating member 11 includes a front shaft member 11*e* integrally connected to the front end of the valve body 11*a* and a back shaft member 11*f* integrally connected to the back end of the valve body 11*a*. The front shaft member 11*e* and the back shaft member 11*f* each extend along the front-back direction. The front shaft member 11*e* can be advanced or retracted inside the air intake passage 12*g* by the actuating member 11 advancing or retracting. The back shaft member 11*f* can be advanced or retracted inside the exhaust passage 12*h* by the actuating member 11 advancing or retracting.

When the actuating member 11 is in the pressurized position (see FIG. 3), the first sealing portion 11*b* is disposed at a position behind the inlet 12*e* and in front of the connecting port 12*d*, and the second sealing portion 11*c* is disposed at a position behind the outlet 12*c* and in front of the exhaust passage 12*h*. When the actuating member 11 is in the depressurized position (see FIG. 4), the first sealing portion 11*b* is disposed at a position behind the air intake 12*f* and in front of the inlet 12*e*, and the second sealing portion 11*c* is disposed at a position behind the connecting port 12*d* and in front of the outlet 12*c*.

By a rod-shaped tool being inserted into the exhaust passage 12*h* and to push the back shaft member 11*f* of the actuating member 11 forward, the actuating member 11 can be moved from the pressurized position to the depressurized position. Furthermore, by a rod-shaped tool being inserted into the air intake passage 12*g* to push the front shaft member 11*e* of the actuating member 11 backwards, the actuating member 11 can be moved from the depressurized position to the pressurized position.

By the actuating member 11 being moved to the pressurized position, the operating specification of the air pump 1 can be set to a pressurizing specification. Furthermore, by the actuating member 11 being moved to the depressurized position, the operating specification of the air pump 1 can be set to a depressurizing specification.

Figure 5:
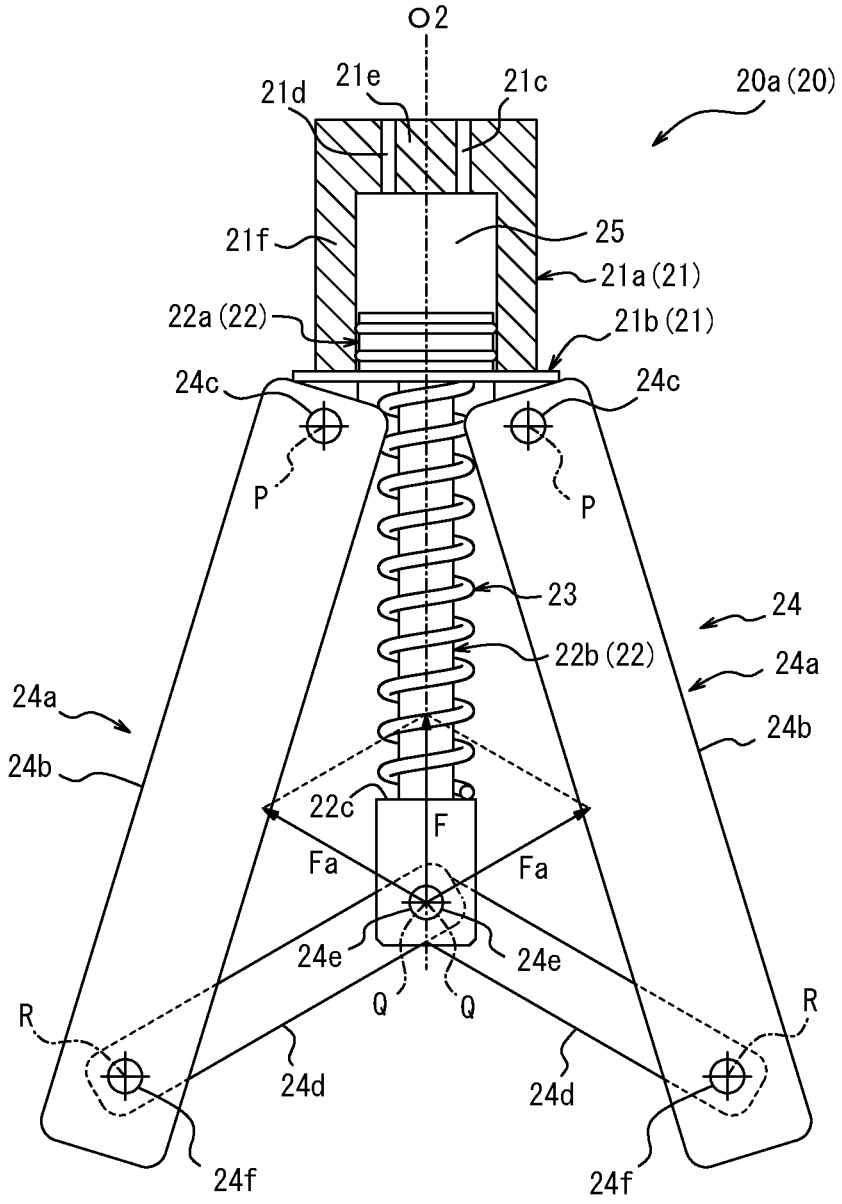
FIG. 5 is a partial cross-sectional plan view of the drive mechanism illustrated in FIG. 1, illustrating the state before a pressing operation.
Figure 6:
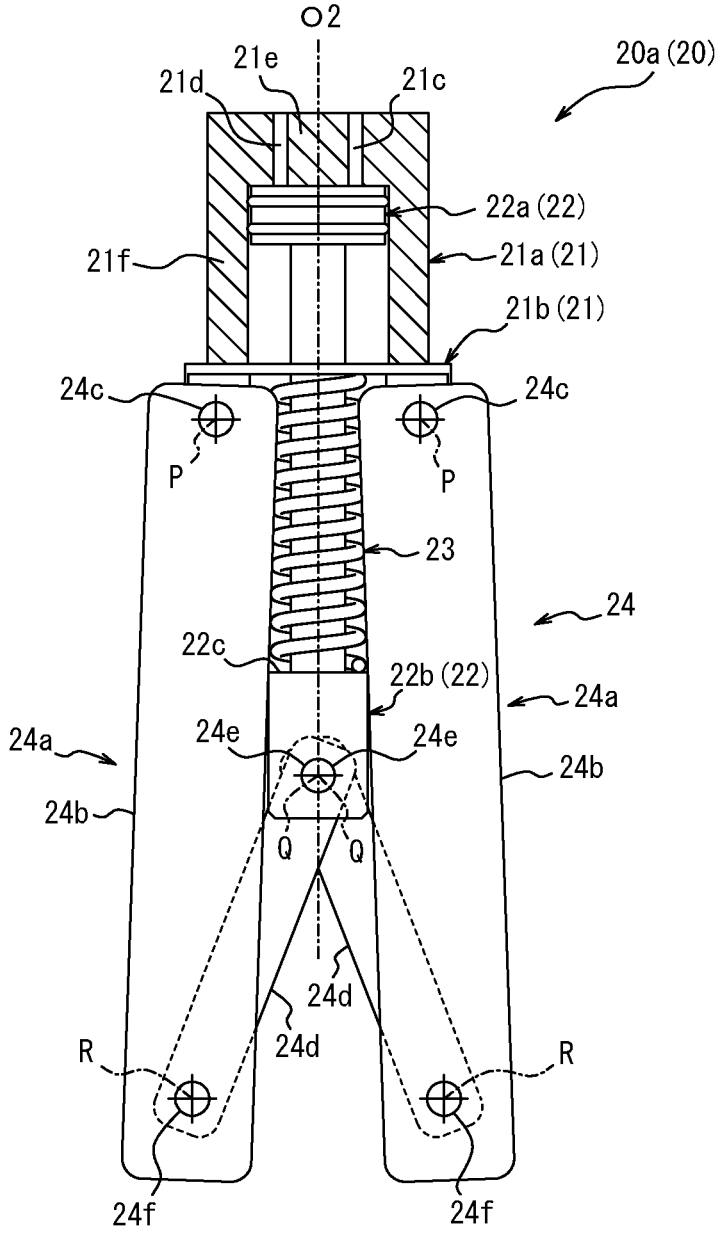
FIG. 6 is a partial cross-sectional plan view illustrating the state when the pressing operation is completed from the state illustrated in FIG. 5.

As illustrated in FIGS. 5 and 6, the hand grip mechanism 20*a* includes a first member 21, a second member 22 connected to the first member 21 in a vertically moveable manner, a spring 23 that provides a biasing force to lower the second member 22 with respect to the first member 21 (for the sake of explanation, the direction of the biasing force provided by the spring 23 is defined as "downward" or "below" in the hand grip mechanism 20*a*), and a hand grip 24 configured by two grip links 24*a*. Each of the grip links 24*a* includes a grip 24*b* rotatably connected to the first member 21, a link 24*d* rotatably connected to the second member 22 below a connecting portion 24*c* between the first member 21 and the grip 24*b*, and a connecting shaft 24*f* rotatably connecting the grip 24*b* and the link 24*d* below a connecting portion 24*e* between the second member 22 and the link 24*d*. The drive mechanism 20 is configured by the hand grip mechanism 20*a*, and a pressure chamber 25 is formed by the first member 21 and the second member 22.

The first member 21 is configured by a cylinder 21*a* and a bottom member 21*b*. In each of the grip links 24*a*, the upper end of the grip 24*b* is rotatably connected to the bottom member 21*b* via the connecting portion 24*c*.

The second member 22 is configured by a piston 22*a* and a central shaft member 22*b*. The central shaft member 22*b* has a second central axis O2 extending vertically. The second central axis O2 is perpendicular to the first central axis O1. The piston 22*a* is integrally connected to the upper end of the central shaft member 22*b*. In each of the grip links 24*a*, the upper end of the grip 24*d* is rotatably connected to the lower end of the central shaft member 22*b* via the connecting portion 24*e*.

The cylinder 21*a* includes a top wall 21*e*, provided with an entrance hole 21*c* that communicates with the inlet 12*e* and an exit hole 21*d* that communicates with the outlet 12*c*, and a peripheral wall 21*f* hanging down from the top wall 21*e*. The bottom member 21*b* is integrally connected to the lower end of the peripheral wall 21*f*. The bottom member 21*b* includes a through hole through which the central shaft member 22*b* passes. The lower portion of the central shaft member 22*b* includes a step 22*c* that expands in diameter downwards, and a coiled spring 23 is disposed between the step 22*c* and the bottom member 21*b*, coaxially with the second central axis O2.

The piston 22*a* is slidable in the vertical direction on the inner peripheral surface of the peripheral wall 21*f* of the cylinder 21*a*. The pressure chamber 25 is formed by the cylinder 21*a* (the lower surface of the top wall 21*e* and the inner peripheral surface of the peripheral wall 21*f*) and the piston 22*a*. Accordingly, the pressure chamber 25 communicates with both the inlet 12*e* and the outlet 12*c* and is driven by the hand grip mechanism 20*a* to increase or decrease in volume.

The two grip links 24*a* face each other across the second central axis O2 and have a substantially symmetrical structure across the second central axis O2. In other words, the second central axis O2 is also the central axis of the hand grip 24. Each connecting portion 24*c* connects the grip 24*b* and the first member 21 rotatably about a rotation axis P. Each connecting portion 24*e* connects the second member 22 and the link 24*d* rotatably about a rotation axis Q. Each connecting shaft 24*f* connects the grip 24*b* and the link 24*d* rotatably about a rotation axis R. The rotation axis P, the rotation axis Q, and the rotation axis R are parallel to each other. Each rotation axis Q intersects the second central axis O2.

In each grip link 24*a*, the connecting portion 24*c* between the grip 24*b* and the first member 21 is, for example, configured by a rotation shaft fixed to the grip 24*b*, the connecting portion 24*e* between the second member 22 and the link 24*d* is, for example, configured by a rotation shaft fixed to the second member 22, and the connecting shaft 24*f* between the grip 24*b* and the link 24*d* is, for example, fixed to the grip 24*b*.

Accordingly, by the pressing operation to squeeze the hand grip 24 against the biasing force of the spring 23, a pressing force Fa in the direction from the connecting shaft 24*f* (rotation axis R) at the lower end of the link 24*d* to the connecting portion 24*e* (rotation axis Q) at the upper end of the link 24*d* is applied to the connecting portion 24*e* in each grip link 24*a*. As a result, an upward combined force F of these pressing forces Fa is applied to the second member 22, thereby raising the second member 22 relative to the first member 21 to reduce the volume of the pressure chamber 25. Furthermore, by the pressing operation being released, the second member 22 can be lowered relative to the first member 21 by the biasing force of the spring 23 to increase the volume of the pressure chamber 25.

In this way, the pressure chamber 25 is driven to increase or decrease the volume manually, more specifically by the hand grip 24 being squeezed against the biasing force of the spring 23, and even more specifically by performance of a driving operation including a pressing operation, to squeeze the hand grip 24 against the biasing force of the spring 23, and release of the pressing operation.

The air pump 1 includes a first check valve, not illustrated, that permits air to flow from the inlet 12*e* into the pressure chamber 25 while preventing air from flowing out of the pressure chamber 25 into the inlet 12*e*, and a second check valve, not illustrated, that permits air to flow from the pressure chamber 25 into the outlet 12*c* while preventing air from flowing out of the outlet 12*c* into the pressure chamber 25. The first check valve is, for example, provided between the inflow passage 12*i* and the entrance hole 21*c*. The second check valve is, for example, provided between the outflow passage 12*k* and the exit hole 21*d*.

Figure 7:
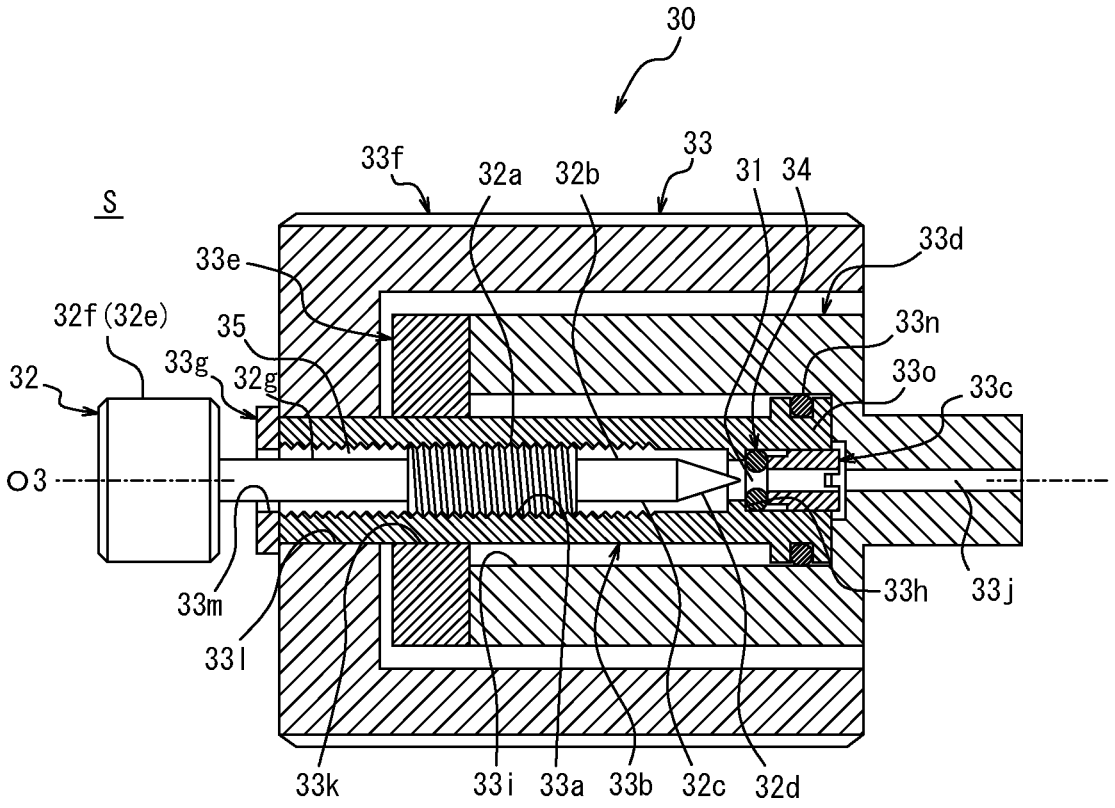
FIG. 7 is a cross-sectional view of a vent mechanism illustrated in FIG. 1, illustrating the state when a vent opening is opened.
Figure 8:
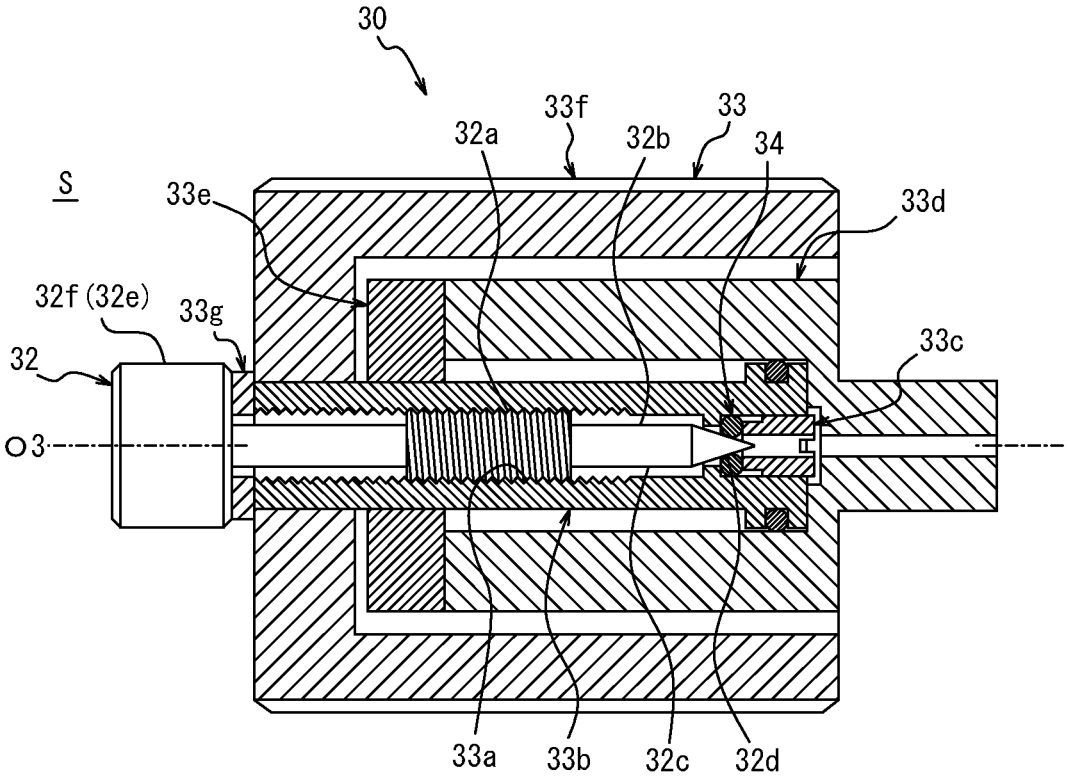
FIG. 8 is a cross-sectional view illustrating the state when the vent opening is closed from the state illustrated in FIG. 7.

As illustrated in FIGS. 7 to 8, the vent mechanism 30 includes a vent opening 31 that communicates with the connecting port 12*d* of the flow path switching mechanism 10 both when the actuating member 11 is in the pressurized position and in the depressurized position, and an opening and closing member 32 configured to open and close the vent opening 31.

The vent opening 31 is formed by a sealing member 34 that is held in a block 33. The opening and closing member 32 opens and closes the vent opening 31 by close contact with and separation from the sealing member 34.

The opening and closing member 32 can be advanced or retracted between an open position (see FIG. 7) to open the vent opening 31 and a closed position (see FIG. 8) to close the vent opening 31. The opening and closing member 32 includes a first screw portion 32*a*, which is a screwing portion that screws into the block 33 over the entire distance between the open position and the closed position, and a shaft body 32*b* that connects to the end at the front (for the sake of explanation, the direction from the open position towards the closed position is defined as "front" or "forward" in the vent mechanism 30) of the first screw portion 32*a* (i.e. connects to the front end of the first screw portion 32*a*) in the direction from the open position towards the closed position and that can be advanced or retracted together with the first screw portion 32*a*. The first screw portion 32*a* has a third central axis O3 and can be advanced or retracted in the front-back direction along the third central axis O3 by rotating about the third central axis O3. The shaft body 32*b* is separated from the sealing member 34 in the open position to open the vent opening 31 and is in close contact with the sealing member 34 in the closed position to close the vent opening 31.

The shaft body 32*b* is integrally connected to the first screw portion 32*a*. The shaft body 32*b* may be configured to be connected to the first screw portion 32*a* so as to be rotatable relative to the first screw portion 32*a* about the third central axis O3.

The shaft body 32*b* includes an equal-diameter portion 32*c* with a constant outer diameter, and a reduced-diameter portion 32*d* that is connected to the front end of the equal-diameter portion 32*c* and decreases in outer diameter toward the front. The reduced-diameter portion 32*d* forms the front end of the shaft body 32*b*. The sealing member 34 has an annular shape and is elastic. By the opening and closing member 32 advancing from the open position to the closed position, the shaft body 32*b* comes into close contact with the sealing member 34 at the reduced-diameter portion 32*d*, thereby closing the vent opening 31.

The opening and closing member 32 is connected to the back end of the first screw portion 32*a* and includes a first operated portion 32*e* that is an operated portion rotatable together with the first screw portion 32*a*. The first operated portion 32*e* is configured by a first grip 32*f*, which is a grip rotatable together with the first screw portion 32*a*. The first operated portion 32*e* is connected to the back end of the first screw portion 32*a* via a shaft 32*g* that has a smaller diameter than the first operated portion 32*e*.

The first operated portion 32*e* is integrally connected to the first screw portion 32*a*. The first operated portion 32*e* may be configured to be connected to the first screw portion 32*a* in a relatively moveable manner in the front-back direction.

The block 33 includes a retaining cylinder 33*b* provided with a first screwed portion 33*a*, which is a screwed portion into which the first screw portion 32*a* screws, a first set screw 33*c*, a base member 33*d*, a lid member 33*e*, a cover member 33*f*, and a washer 33*g*. The retaining cylinder 33*b* has a cylindrical shape coaxial with the third central axis O3 and is provided with the first screwed portion 33*a* on the inner peripheral surface. The first set screw 33*c* has a cylindrical shape coaxial with the third central axis O3. The outer peripheral surface of the first set screw 33*c* screws into the tip of the inner peripheral surface of the retaining cylinder 33*b*. The inner peripheral surface of the retaining cylinder 33*b* includes a step 33*h* that expands in diameter toward the front, and the sealing member 34 is sandwiched between this step 33*h* and the back end of the first set screw 33*c*.

The base member 33*d* includes a housing recess 33*i* that houses the front end of the retaining cylinder 33*b* and a communication channel 33*j* for the vent opening 31 to communicate with the connecting port 12*d* of the flow path switching mechanism 10. The housing recess 33*i* is closed by an annular lid member 33*e* provided with a first through hole 33*k*, which is a through hole through which the retaining cylinder 33*b* passes. The cover member 33*f* is provided with a second through hole 33*l*, which is a through hole through which the retaining cylinder 33*b* passes, and covers the lid member 33*e* and a majority of the base member 33*d*. The washer 33*g* has an annular shape provided with a third through hole 33*m*, which is a through hole through which the shaft portion 32*g* of the opening and closing member 32 passes. The washer 33*g* is attached to the back end surface of the retaining cylinder 33*b*. The washer 33*g* is made of synthetic resin, for example, and has elasticity enabling compression in the front-back direction. In the closed position, the washer 33*g* is sandwiched and compressed between the front end surface of the first operated portion 32*e* and the back end surface of the retaining cylinder 33*b*. The outer peripheral surface of the retaining cylinder 33*b* is provided with a third sealing portion 33*n*, which is a sealing portion that closely contacts the inner peripheral surface of the housing recess 33*i*. The third sealing portion 33*n* is configured by an annular elastic member that is integrally connected to a retaining member body 33*o*.

The first screw portion 32*a* and the first screwed portion 33*a* are right-hand threads. The first screw portion 32*a* and the first screwed portion 33*a* may, however, be left-hand threads. The first screw portion 32*a* has a male thread, and the first screwed portion 33*a* has a female thread. The thread shape and the like of the male thread and the female thread can be set as appropriate. The first screw portion 32*a* and the first screwed portion 33*a* may be intermittent screws in which the threads are provided intermittently.

When the opening and closing member 32 is in the open position, the vent opening 31 is connected to the external space S through the ventilation channel 35. The ventilation channel 35 is configured by a gap between the opening and closing member 32 and the retaining cylinder 33*b*, which includes a non-illustrated gap between the first screw portion 32*a* and the first screwed portion 33*a*. A ventilation channel that connects the vent opening 31 to the external space S when the opening and closing member 32 is in the open position may be provided instead of or in addition to the ventilation channel 35.

The air pump 1 is used by connecting the connecting channel 12*j* to the end of an internal space of a non-illustrated object to pressurize or depressurize the internal space.

When the drive mechanism 20 is driven so as to drive the pressure chamber 25 while the operating specification of the air pump 1 has been set to the pressurizing specification, the air pump 1 can send air from the external space S to the internal space of the object through the air intake 12*f*, the inflow passage 12*i*, the entrance hole 21*c*, the pressure chamber 25, the exit hole 21*d*, the outflow passage 12*k*, and the connecting channel 12*j* in this order to pressurize the internal space of the object. When the drive mechanism 20 is driven so as to drive the pressure chamber 25 while the operating specification of the air pump 1 has been set to the depressurizing specification, the air pump 1 can send air from the internal space of the object to the external space S through the connecting channel 12*j*, the inflow passage 12*i*, the entrance hole 21*c*, the pressure chamber 25, the exit hole 21*d*, the outflow passage 12*k*, and the exhaust port 12*b* in this order to depressurize the internal space of the object.

The positive or negative pressure imparted to the internal space of the object by the air pump 1 can be weakened and eliminated by operating the opening and closing member 32 of the vent mechanism 30 to open the vent opening 31.

The air pump 1 has a non-illustrated calibration flow path for connecting a first pressure device, which is a pressure device such as a pressure gauge and serves as an object, to an end of an internal space of a second pressure device, which is a pressure device such as a pressure gauge that serves as a reference for calibrating the first pressure device. The calibration flow path is provided to communicate with the connecting port 12*d* of the flow path switching mechanism 10 when the actuating member 11 is in both the pressurized position and the depressurized position.

To calibrate the first pressure device, the end of the internal space of the first pressure device is connected to the connecting channel 12*j*, and the end of the internal space of the second pressure device is connected to the calibration flow path. Therefore, the first pressure device can be calibrated by using the air pump 1 to apply the same positive or negative pressure to the first pressure device and the second pressure device.

There is demand for improved operability of the hand grip mechanism 20*a* of the present comparative example by a reduction in the operating force required for the pressing operation, in particular the operating force required at the end of the pressing operation.

Figure 9:
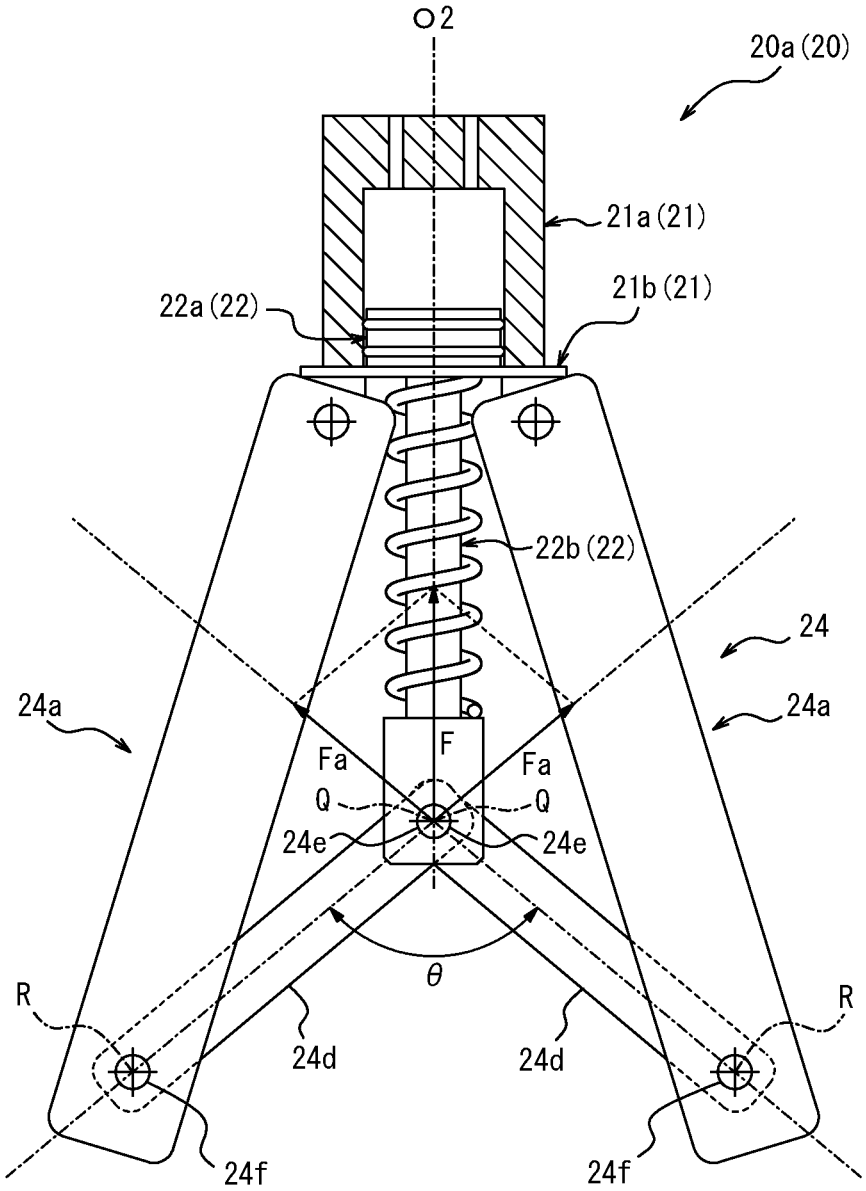
FIG. 9 is a partial cross-sectional plan view of a drive mechanism configured by a hand grip mechanism according to a second comparative example, illustrating the state before a pressing operation.
Figure 10:
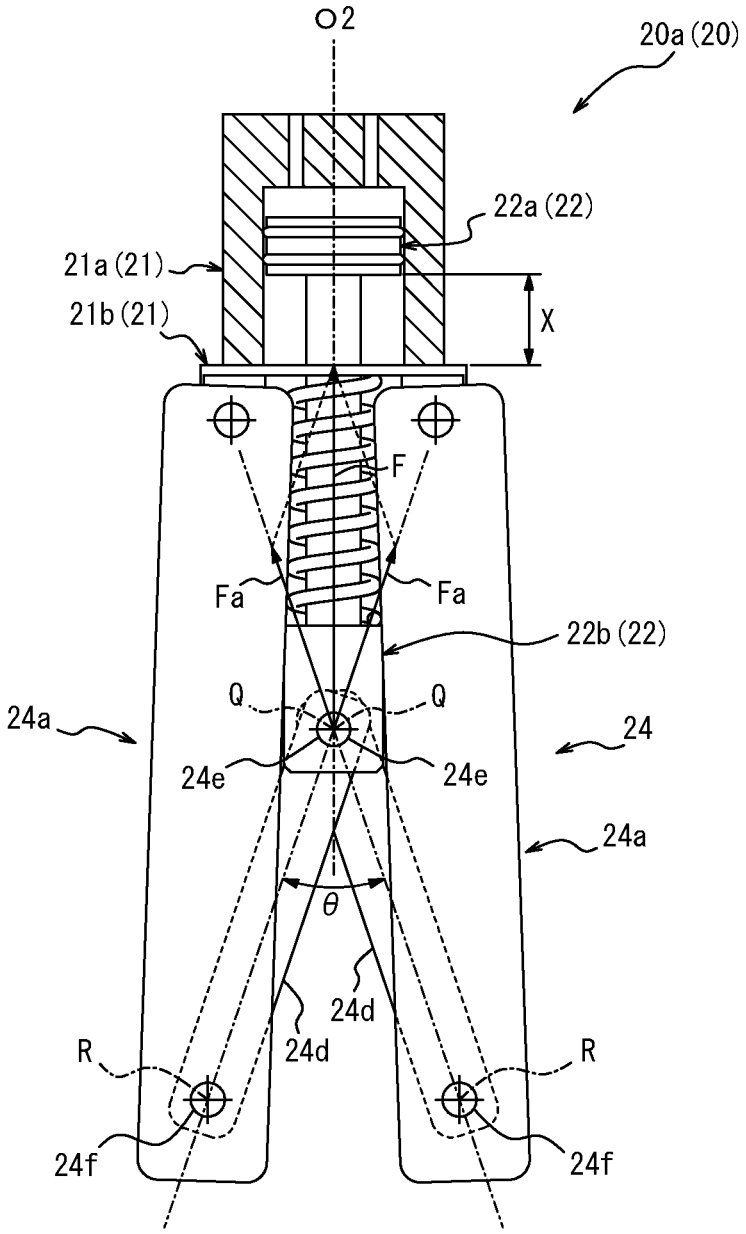
FIG. 10 is a partial cross-sectional plan view illustrating the state when the pressing operation is completed from the state illustrated in FIG. 9.

One way to meet such demand could, for example, be to set a larger distance for each grip link 24*a* between the rotation axis R of the connecting shaft 24*f* and the rotation axis Q of the connecting portion 24*e* that connects the second member 22 and the link 24*d*, and to set a smaller link angle θ, which is the downward angle formed by a straight line passing through the rotation axis R of one connecting shaft 24*f* and the rotation axis Q of the connecting portion 24*e* between the link 24*d*, connected to the one connecting shaft 24*f*, and the second member 22, and a straight line passing through the rotation axis R of the other connecting shaft 24*f* and the rotation axis Q of the connecting portion 24*e* between the link 24*d*, connected to the other connecting shaft 24*f*, and the second member 22, as in the hand grip mechanism 20*a* according to the second comparative example illustrated in FIGS. 9 and 10. In this case, however, the stroke amount X of the lifting stroke of the second member 22 relative to the first member 21 is reduced.

Figure 11:
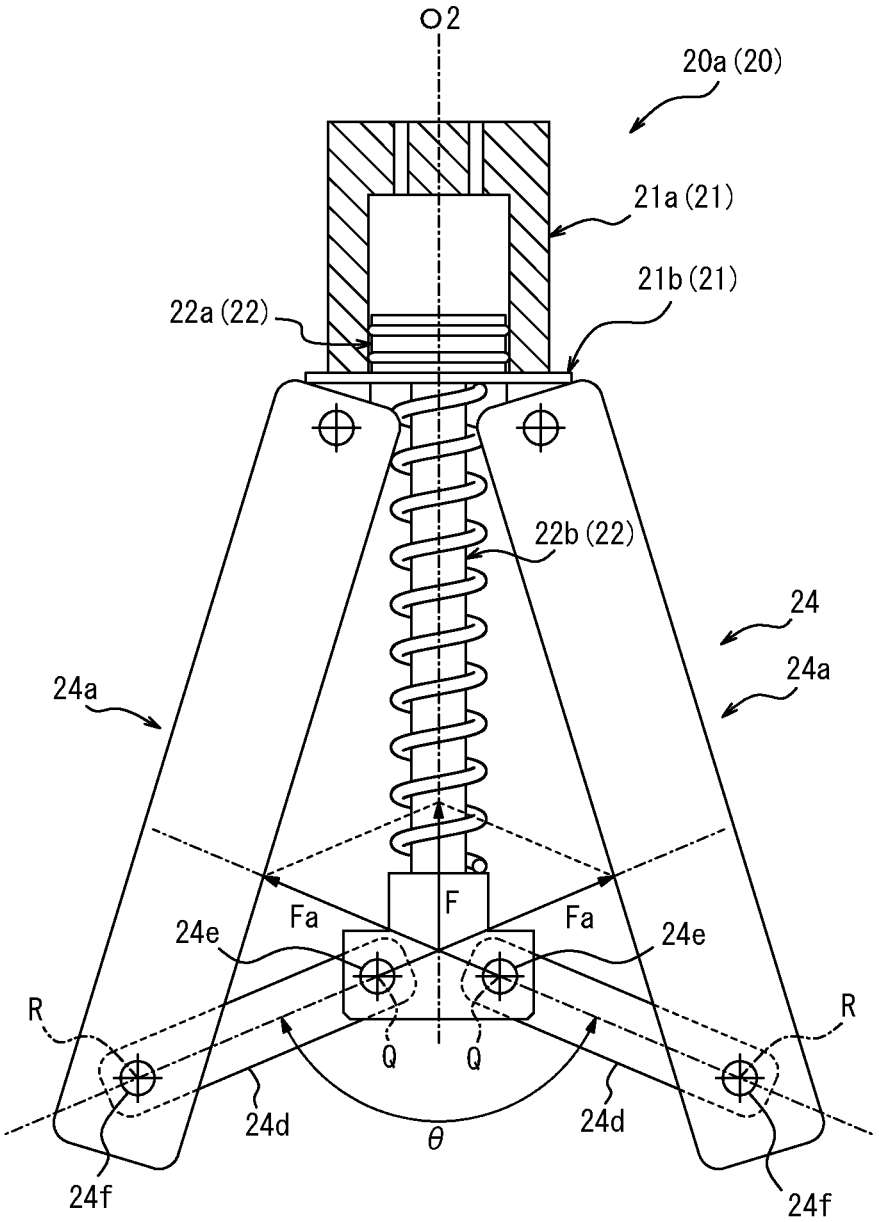
FIG. 11 is a partial cross-sectional plan view of a drive mechanism configured by a hand grip mechanism according to a third comparative example, illustrating the state before a pressing operation.
Figure 12:
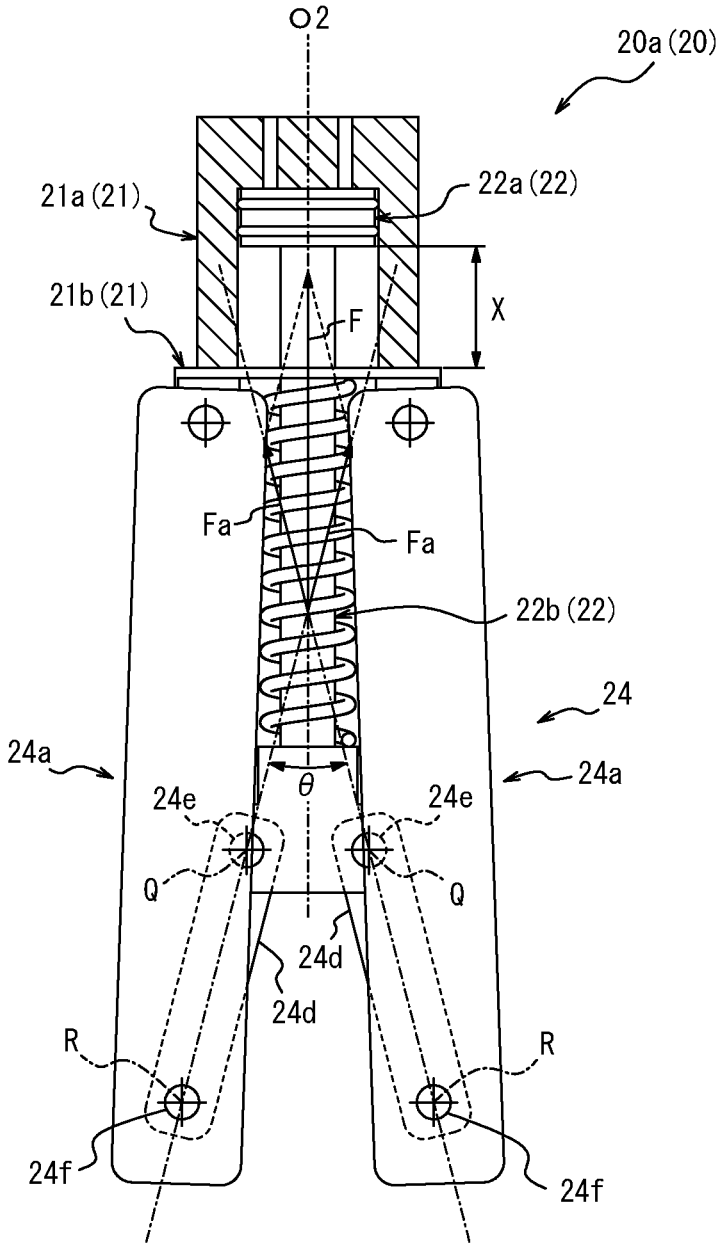
FIG. 12 is a partial cross-sectional plan view illustrating the state when the pressing operation is completed from the state illustrated in FIG. 11.

A way to reduce the operating force required at the end of the pressing operation while ensuring the stroke amount X could, for example, be to provide, for each grip link 24*a*, the rotation axis Q of the connecting portion 24*e* that connects the second member 22 and the link 24*d* farther inward than the second central axis O2, which is the central axis of the hand grip 24, when viewed from the grip link 24*a* (that is, on the side where the connecting shaft 24*f* is positioned when viewed from a plane that includes the second central axis O2 and is parallel to the rotation axis R of the connecting shaft 24*f*), as in the hand grip mechanism 20*a* according to the third comparative example illustrated in FIGS. 11 and 12. In this case, however, the link angle θ at the start of the pressing operation becomes larger, increasing the operating force required at the start of the pressing operation.

The embodiment of the present disclosure described below can improve operability over the above-described first comparative example by reducing the operating force required for the pressing operation, in particular the operating force required at the end of the pressing operation. More specifically, the embodiment of the present disclosure can improve operability by reducing the operating force required at the end of the pressing operation without increasing the operating force required at the start of the pressing operation, while ensuring the stroke amount X.

In the hand grip mechanism 20*a* of one embodiment illustrated in FIGS. 13 to 15, each grip link 24*a* includes a first connecting shaft 24*g* and a second connecting shaft 24*h* that each connect the grip 24*b* and the link 24*d* below the connecting portion 24*e* that connects the second member 22 and the link 24*d*, instead of including the connecting shaft 24*f* that rotatably connects the grip 24*b* and the link 24*d* below the connecting portion 24*e* that connects of the second member 22 and the link 24*d*. Also, in the hand grip mechanism 20*a* according to the present embodiment, the grip 24*b* and the link 24*d* in the respective grip links 24*a* rotate relative to each other, as a result of the pressing operation, about a rotation axis R1, which is the central axis of the first connecting shaft 24*g*, during initial movement and rotate relative to each other about a rotation axis R2, which is the central axis of the second connecting shaft 24*h*, during final movement. Furthermore, in the hand grip mechanism 20*a* according to the present embodiment, in each of the grip links 24*a*, the rotation axis Q of the connecting portion 24*e* that connects the second member 22 and the link 24*d* is provided farther inward than the second central axis O2, which is the central axis of the hand grip 24, when viewed from the grip link 24*a* (that is, on the side where the first connecting shaft 24*g* is positioned when viewed from a plane that includes the second central axis O2 and is parallel to the rotation axis R1 of the first connecting shaft 24*g*).

Apart from these points, the hand grip mechanism 20*a* according to the present embodiment has a similar configuration to that of the hand grip mechanism 20*a* according to the first comparative example. The air pump 1 according to the present embodiment has a similar configuration to that of the air pump 1 according to the first comparative example in other respects.

Figure 13:
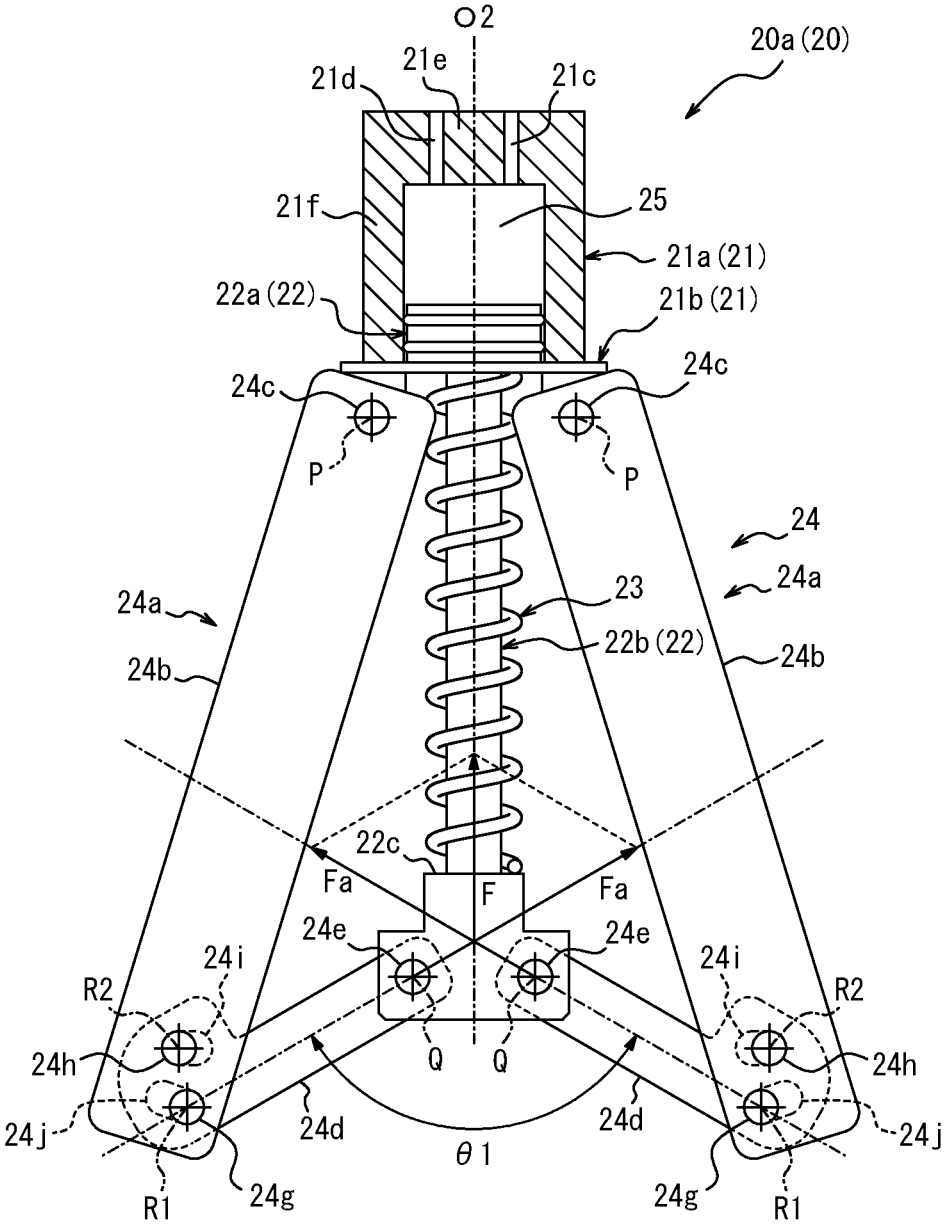
FIG. 13 is a partial cross-sectional plan view of a drive mechanism configured by a hand grip mechanism according to an embodiment, illustrating the state at the start of initial movement.
Figure 14:
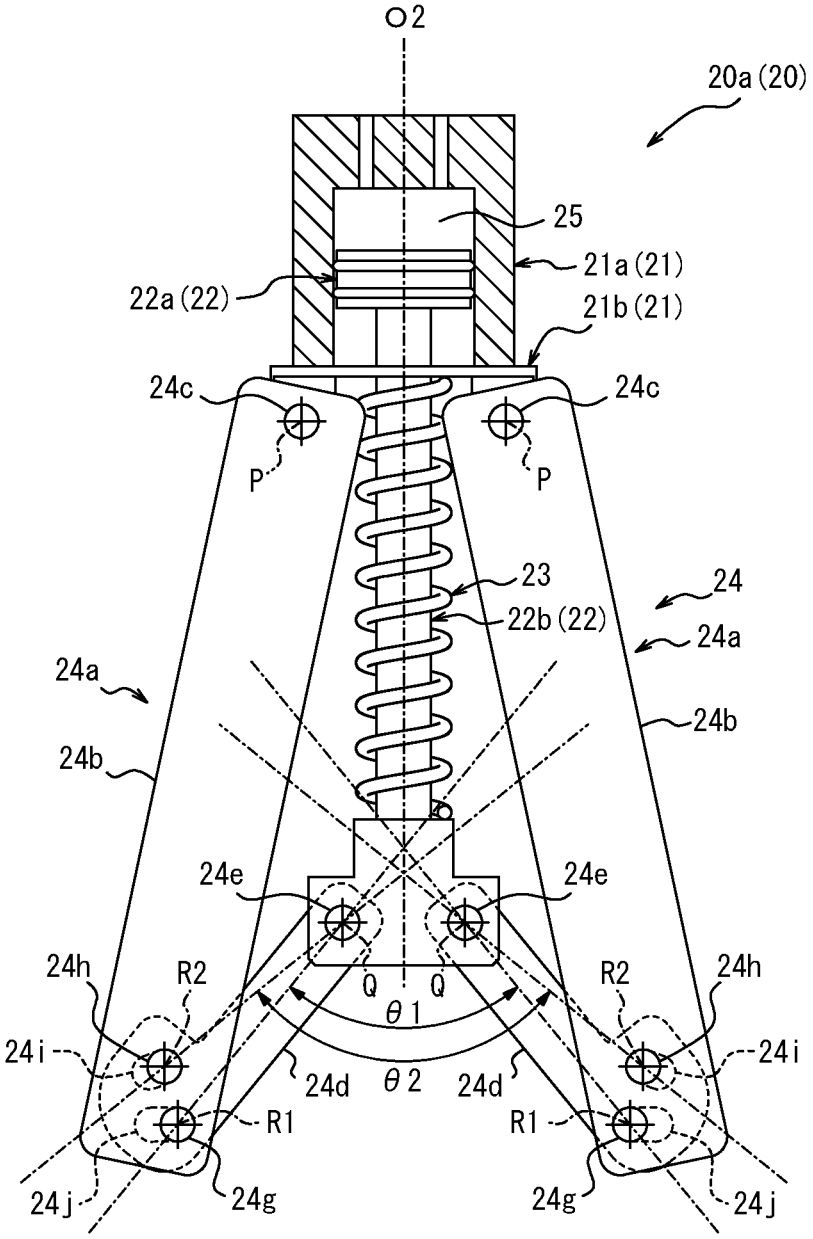
FIG. 14 is a partial cross-sectional plan view illustrating the state when the initial movement is completed by the pressing operation from the state illustrated in FIG. 13 (i.e. illustrating the state representing both completion of initial movement and the start of final movement)
Figure 15:
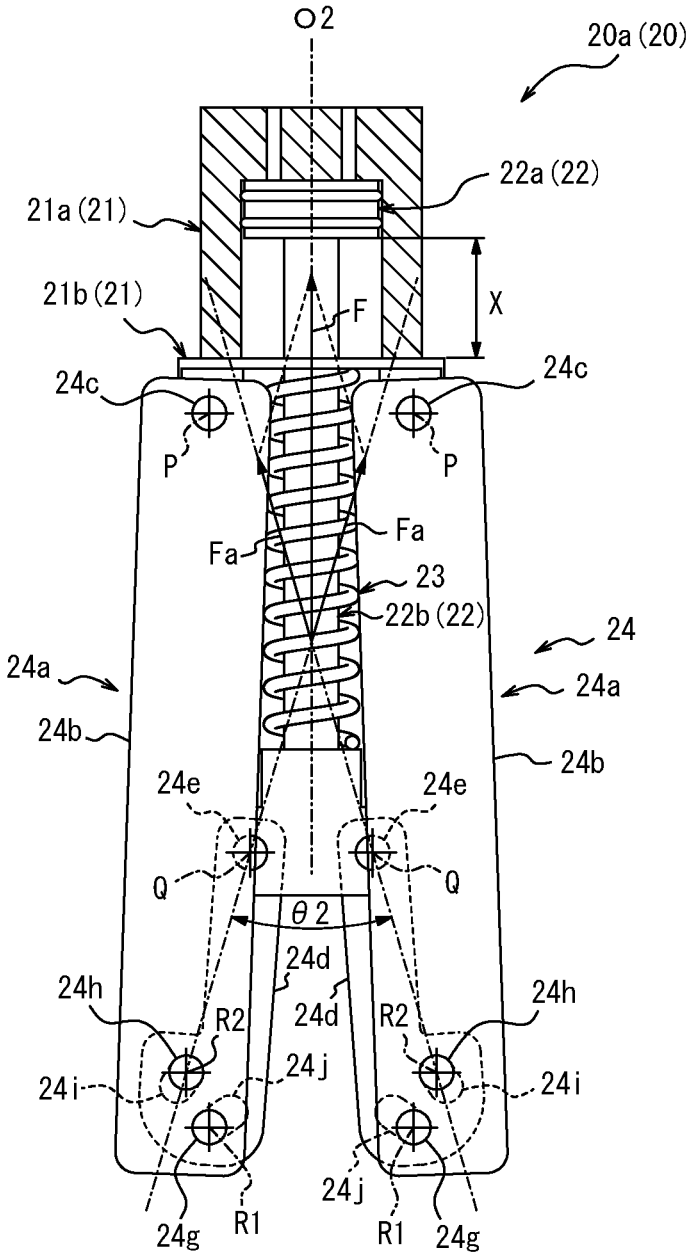
FIG. 15 is a partial cross-sectional plan view illustrating the state when the final movement is completed by the pressing operation from the state illustrated in FIG. 14 (i.e. illustrating the state at completion of final movement).

As illustrated in FIGS. 13 to 15, in the present embodiment, the first connecting shaft 24*g* and the second connecting shaft 24*h* are fixed to the respective grips 24*b* in the grip links 24*a*. The rotation axis R1, which is the central axis of each first connecting shaft 24*g*, and the rotation axis R2, which is the central axis of each second connecting shaft 24*h*, are respectively parallel to the rotation axis P and the rotation axis Q.

In each of the grip links 24*a*, the lower end of the link 24*d* includes a first guiding portion 24*i* that guides the second connecting shaft 24*h* in the circumferential direction of the rotation axis R1 of the first connecting shaft 24*g* to cause the grip 24*b* and the link 24*d* to rotate relative to each other about the rotation axis R1 of the first connecting shaft 24*g* (see FIGS. 13 and 14) during the initial movement by the pressing operation. The first guiding portion 24*i* is configured as a cutout in the shape of an elongated hole. The first guiding portion 24*i* may be configured as a cutout in a shape other than that of an elongated hole.

In each of the grip links 24*a*, the lower end of the link 24*d* includes a second guiding portion 24*j* that guides the first connecting shaft 24*g* in the circumferential direction of the rotation axis R2 of the second connecting shaft 24*h* to cause the grip 24*b* and the link 24*d* to rotate relative to each other about the rotation axis R2 of the second connecting shaft 24*h* (see FIGS. 14 and 15) during the final movement by the pressing operation. The second guiding portion 24*j* is configured as a cutout in the shape of an elongated hole. The second guiding portion 24*j* may be configured as a cutout in a shape other than that of an elongated hole.

In each of the grip links 24*a*, the first connecting shaft 24*g* and the second connecting shaft 24*h* may be fixed to the link 24*d*, and the first guiding portion 24*i* and the second guiding portion 24*j* may be provided in the grip 24*b*.

In the present embodiment, as illustrated in FIGS. 13 and 14, the grip 24*b* and the link 24*d* can be rotated relative to each other about the first connecting shaft 24*g* (rotation axis R1) from the start of initial movement by the pressing operation to the end of initial movement in each of the grip links 24*a*, and as illustrated in FIGS. 14 to 15, the grip 24*b* and the link 24*d* can be rotated relative to each other about the second connecting shaft 24*h* (rotation axis R2) from the start of initial movement by the pressing operation to the end of initial movement in each of the grip links 24*a*. Therefore, according to the present embodiment, appropriately setting the positions of the first connecting axis 24*g* and the second connecting axis 24*h* enables an increase in the stroke amount obtained by the final movement by switching the center of rotation from the first connecting shaft 24*g* (rotation axis R1) to the second connecting shaft 24*h* (rotation axis R2) at the start of the final movement, which is at the end of the initial movement. In other words, a first link angle θ1 at the start of the initial movement or a second link angle θ2 at the start of the final movement can be set smaller in correspondence with the increase in the stroke amount, achieving a decrease in the operating force required for the pressing operation.

Here, the first link angle θ1 is the downward angle formed by a straight line passing through one first connecting shaft 24*g* (rotation axis R1) and the connecting portion 24*e* (rotation axis Q) between the link 24*d*, connected to the one first connecting shaft 24*g*, and the second member 22, and a straight line passing through the other first connecting shaft 24*g* (rotation axis R1) and the connecting portion 24*e* (rotation axis Q) between the link 24*d*, connected to the other first connecting shaft 24*g*, and the second member 22. The second link angle θ2 is the downward angle formed by a straight line passing through one second connecting shaft 24*h* (rotation axis R2) and the connecting portion 24*e* (rotation axis Q) between the link 24*d*, connected to the one second connecting shaft 24*h*, and the second member 22, and a straight line passing through the other second connecting shaft 24*h* (rotation axis R2) and the connecting portion 24*e* (rotation axis Q) between the link 24*d*, connected to the other second connecting shaft 24*h*, and the second member 22.

In the present embodiment, according to the above configuration, operability of the initial movement is maintained with an equivalent link angle θ (first link angle θ1) at the start of the initial movement as in the first comparative example, while ensuring a stroke amount X equivalent to that of the first comparative example, and operability of the final movement is improved by reducing the link angle θ (second link angle θ2) at the end of the final movement as compared to the first comparative example.

The aforementioned effect can be obtained more reliably by setting the positions of the first connecting shaft 24*g* and the second connecting shaft 24*h* so that the second link angle θ2 is larger than the first link angle θ1 at the start of the final movement, which is the end of the initial movement.

In the present embodiment, in each of the grip links 24*a*, the rotation axis Q of the connecting portion 24*e* that connects the second member 22 and the link 24*d* is provided farther inward than the second central axis O2 when viewed from the grip link 24*a*. This makes it easier to set a smaller link angle θ (second link angle θ2) at the end of the final movement, more reliably enabling improvement in operability.

In the present embodiment, each of the grip links 24*a* has only two connecting shafts (the first connecting shaft 24*g* and the second connecting shaft 24*h*) that connect the grip 24*b* and the link 24*d*. Each of the grip links 24*a* may, however, be configured to have three or more connecting shafts that connect the grip 24*b* and the link 24*d*. For example, a configuration may be adopted in which each of the grip links 24*a* includes a first connecting shaft 24*g*, a second connecting shaft 24*h*, and a third connecting shaft that each connect the grip 24*b* and the link 24*d*, and the grip 24*b* and the link 24*d* in each of the grip links 24*a* may rotate relative to each other about the first connecting shaft 24*g* during the initial movement by the pressing operation, about the third connecting shaft from the end of the initial movement until the start of the final movement, and about the second connecting shaft 24*h* during the final movement.

Various modifications may be made in the present embodiment, as long as the flow path switching mechanism 10 includes the actuating member 11 provided with the valve body 11*a*, and the housing 12 provided with the valve chamber 12*a* configured to house the valve body 11*a* in an advanceable and retractable manner between the pressurized position and the depressurized position, and the valve body 11*a* is configured to enable the intake port 12*f* to communicate with the inlet 12*e* and enable the outlet 12*c* to communicate with the connecting port 12*d* in the pressurized position, and to enable the connecting port 12*d* to communicate with the inlet 12*e* and enable the outlet 12*c* to communicate with the exhaust port 12*b* in the depressurized position. Various modifications may also be made in the present embodiment as long as the vent mechanism 30 includes the vent opening 31 that communicates with the connecting port 12*d* of the flow path switching mechanism 10 both when the actuating member 11 is in the pressurized position and in the depressurized position, and the opening and closing member 32 configured to open and close the vent opening 31.

The above embodiment is an example of the present disclosure, and a variety of modifications may be made.

For example, the hand grip mechanism 20*a*, the drive mechanism 20, and the air pump 1 according to the above embodiment can be modified in various ways as described below.

Various modifications may be made to the hand grip mechanism 20*a* according to the above embodiment as long as the hand grip mechanism 20*a* includes the first member 21, the second member 22 connected to the first member 21 in a vertically moveable manner, the spring 23 configured to provide a biasing force to lower the second member 22 with respect to the first member 21, and the hand grip 24 configured by the two grip links 24*a*, each grip link 24*a* including the grip 24*b* rotatably connected to the first member 21, the link 24*d* rotatably connected to the second member 22 below the connecting portion 24*c* between the first member 21 and the grip 24*b*, and the first connecting shaft 24*g* and the second connecting shaft 24*h* each connecting the grip 24*b* and the link 24*d* below the connecting portion 24*e* between the second member 22 and the link 24*d*, and by a pressing operation to squeeze the hand grip 24 against the biasing force, the grip 24*b* and the link 24*d* in each grip link 24*a* rotate relative to each other about the first connecting shaft 24*g* during initial movement and rotate relative to each other about the second connecting shaft 24*h* during final movement.

At the start of final movement, however, the downward angle (second link angle θ2) formed by a straight line passing through one second connecting shaft 24*h* and the connecting portion 24*e* between the link 24*d*, connected to the one second connecting shaft 24*h*, and the second member 22, and a straight line passing through the other second connecting shaft 24*h* and the connecting portion 24*e* between the link 24*d*, connected to the other second connecting shaft 24*h*, and the second member 22 is preferably larger than the downward angle (first link angle θ1) formed by a straight line passing through one first connecting shaft 24*g* and the connecting portion 24*e* between the link 24*d*, connected to the one first connecting shaft 24*g*, and the second member 22, and a straight line passing through the other first connecting shaft 24*g* and the connecting portion 24*e* between the link 24*d*, connected to the other first connecting shaft 24*g*, and the second member 22.

In each grip link 24*a*, the connecting portion 24*e* between the second member 22 and the link 24*d* is preferably provided farther inward than the central axis (second central axis O2) of the hand grip 24 when viewed from the grip link 24*a*.

Various modifications may be made to the drive mechanism 20 according to the above embodiment as long as the drive mechanism 20 is configured by the hand grip mechanism 20*a*, and the pressure chamber 25 is formed by the first member 21 and the second member 22.

In the drive mechanism 20, however, the first member 21 preferably includes the cylinder 21*a*, and the second member 22 preferably includes the piston 22*a*.

The air pump 1 according to the above embodiment can be modified in various ways as long as the air pump 1 includes the drive mechanism 20.

The air pump 1, however, preferably includes the flow path switching mechanism 10, which includes the actuating member 11 provided with the valve body 11*a*, and the housing 12 provided with the valve chamber 12*a* configured to house the valve body 11*a* in an advanceable and retractable manner between the pressurized position and the depressurized position, the valve body 11*a* being configured to enable the intake port 12*f* to communicate with the inlet 12*e* and enable the outlet 12*c* to communicate with the connecting port 12*d* in the pressurized position, and to enable the connecting port 12*d* to communicate with the inlet 12*e* and enable the outlet 12*c* to communicate with the exhaust port 12*b* in the depressurized position. The pressure chamber 25 preferably communicates with the inlet 12*e* and the outlet 12*c*.

Furthermore, the air pump 1 preferably includes the vent opening 31 configured to communicate with the connecting port 12*d* of the flow path switching mechanism 10 both when the actuating member 11 is in the pressurized position and in the depressurized position, and the opening and closing member 32 configured to open and close the vent opening 31.

The invention claimed is:

1. A hand grip mechanism comprising:

a first member;

a second member connected to the first member in a vertically moveable manner;

a spring configured to provide a biasing force to lower the second member with respect to the first member; and a hand grip configured by two grip links, each grip link comprising:

a grip rotatably connected to the first member, a link rotatably connected to the second member below a first connecting portion between the first member and the grip, and a first connecting shaft and a second connecting shaft each connecting the grip and the link below a second connecting portion between the second member and the link, wherein by a pressing operation to squeeze the hand grip against the biasing force, the grip and the link in each grip link rotate relative to each other about the first connecting shaft during initial movement and rotate relative to each other about the second connecting shaft during final movement, wherein a second downward angle is formed by a first straight line passing through a first second connecting shaft and the second connecting portion between the respective link, connected to the first second connecting shaft, and the second member, and a second straight line passing through a second second connecting shaft and the second connecting portion between the respective link, connected to the second second connecting shaft, and the second member; wherein the second downward angle is larger than a first downward angle formed by a third straight line passing through a first first connecting shaft and the second connecting portion between the respective link, connected to the first first connecting shaft, and the second member, and a fourth straight line passing through a second first connecting shaft and the second connecting portion between the respective link, connected to the second first connecting shaft, and the second member.

2. The hand grip mechanism of claim 1, wherein in each grip link, the second connecting portion between the second member and the link is provided farther inward than a central axis of the hand grip when viewed from the grip link.

3. A drive mechanism configured by the hand grip mechanism of claim 1, wherein a pressure chamber is formed by the first member and the second member.

4. An air pump comprising the drive mechanism of claim 3.

5. The air pump of claim 4, further comprising:

a flow path switching mechanism including an actuating member provided with a valve body, and a housing provided with a valve chamber configured to house the valve body in an advanceable and retractable manner between a pressurized position and a depressurized position, the valve body being configured to enable an intake port to communicate with an inlet and enable an outlet to communicate with a connecting port in the pressurized position, and to enable the connecting port to communicate with the inlet and enable the outlet to communicate with an exhaust port in the depressurized position, wherein the pressure chamber is configured to communicate with the inlet and the outlet.

6. The air pump of claim 5, further comprising:

a vent opening configured to communicate with the connecting port of the flow path switching mechanism both when the actuating member is in the pressurized position and in the depressurized position; and an opening and closing member configured to open and close the vent opening.

* * * * *